US006634941B2

(12) United States Patent
Olive

(10) Patent No.: US 6,634,941 B2
(45) Date of Patent: Oct. 21, 2003

(54) GAMING MACHINE WITH SECONDARY GAME INCLUDING A SPECIAL SYMBOL

(75) Inventor: Scott Olive, Sydney (AU)

(73) Assignee: Aristocrat Technologies Australia Pty Ltd., Lane Cove (AU)

( * ) Notice: Subject to any disclaimer, the term of this patent is extended or adjusted under 35 U.S.C. 154(b) by 0 days.

(21) Appl. No.: 09/809,980

(22) Filed: Mar. 16, 2001

(65) Prior Publication Data

US 2002/0025849 A1 Feb. 28, 2002

(30) Foreign Application Priority Data

Mar. 17, 2000 (AU) ..... PQ6296

(51) Int. Cl.[7] ..... A63F 9/24
(52) U.S. Cl. ..... 463/16; 273/138.1
(58) Field of Search ..... 463/12–13, 16–20, 463/25–27, 29–32, 36; 273/138.1, 138.2, 143 A, 143 R, 142 B

(56) References Cited

U.S. PATENT DOCUMENTS 6,126,542 A * 10/2000 Fier ..... 463/16
6,159,095 A * 12/2000 Frohm et al. ..... 463/19
6,159,097 A * 12/2000 Gure ..... 463/20
6,234,897 B1 * 5/2001 Frohm et al. ..... 463/20
6,290,600 B1 * 9/2001 Glasson ..... 463/20
6,358,144 B1 * 3/2002 Kadlic et al. ..... 463/13
6,471,208 B2 * 10/2002 Yoseloff et al. ..... 273/143 R

* cited by examiner

*Primary Examiner*—Kim Nguyen
(74) *Attorney, Agent, or Firm*—Katten Muchin Zavis Rosenman

(57) ABSTRACT

A gaming machine has a display and a game controller arranged to control images displayed on the display. The game controller is arranged to play a game wherein a random event is caused to be displayed on the display. If a predefined winning event results, the machine awards a prize. When a secondary game, following a base game, is completed, a special symbol appears at at least one symbol position of the secondary game. The special symbol replaces, at least temporarily, an underlying symbol at the symbol position to contribute, if applicable, to a prize winning event.

13 Claims, 4 Drawing Sheets

GAMING MACHINE WITH SECONDARY GAME INCLUDING A SPECIAL SYMBOL

FIELD OF THE INVENTION

This invention relates to a gaming machine. More particularly, the invention relates to a gaming machine and to an improvement to a game played on such a gaming machine.

BACKGROUND TO THE INVENTION

Players who regularly play gaming machines quickly tire of particular games and therefore it is necessary for manufacturers of these machines to develop innovative game features which add interest to the games. In so doing, it is hoped to keep players amused and therefore willing to continue playing the games as well as to attract new players.

Also, with the growth that has occurred in the gaming machine market, there is intense competition between manufacturers to supply various existing and new venues. When selecting a supplier of gaming machines, the operator of a venue will often pay close attention to the popularity of various games with their patrons. Therefore gaming machine manufacturers are keen to devise games which are popular with the players as a mechanism for improving sales, retaining customers and attracting new customers.

SUMMARY OF THE INVENTION

According to the invention, there is provided a gaming machine having a display means and a game control means arranged to control images displayed on the display means, the game control means being arranged to play a game wherein one or more random events are caused to be displayed on the display means and, if a predefined winning event results, the machine awards a prize, the gaining machine being characterized in that, when a secondary game, following a base game, is completed, a special symbol appears at at least one symbol position of the secondary game, the special symbol replacing at least temporarily, an underlying symbol at said symbol position to contribute, if applicable, to a prize winning event.

In this specification, the term "secondary game" is to be understood as one of a free game and a bonus game. In a preferred embodiment of the invention, the secondary game is a free game forming part of a series of free games, the series of free games being triggered by a predetermined trigger condition in the base game.

The appearance of the special symbol may occur in each game of the series of free games. Preferably, the special symbol is a substitute symbol.

Hence, once a base game has been completed which triggers a free game or, preferably, a series of free games, each time a free game is completed, any prizes associated with displayed symbols of the free game are paid. Then, for each free game, the game control means may choose a position from all displayed symbol positions on the display means with the special symbol appearing at the chosen symbol position.

The special symbol may be in the form of an animated character. Preferably, the animated character moves across the display means to the chosen position to heighten the anticipation involved with the game. In a preferred game, the substitute symbol is a symbol of a dolphin. When the dolphin symbol arrives at the chosen position, it may "dive" into the underlying symbol.

Once the substitute symbol is in its substituting position, it may substitute for the underlying symbol and if it substitutes in any further prize winning combination, the relevant prize is paid.

The game control means may be operable, after payment of a prize, if any, in a first free game of the series of free games to play the following free game of the series by altering the symbols displayed on the display means and, once said following free game has been completed and prizes, if any, paid, the special symbol again appears at one of the symbol positions as chosen by the game control means. In the case of a spinning reel game, altering the symbols may involve one or more of the reels being respun.

The position chosen by the game control means at which the special symbol appears in one free game may be governed by the position at which it appeared in a preceding free game with the chosen position of the special symbol in a first game of the series being determined by the game control means. Instead the position chosen by the game control means at which the special symbol appears in each free game of the series of free games may be randomly determined by the game control means in each free game.

A win for a prize winning combination in the secondary game may be an integer multiple of a win for the same prize winning combination in the base game.

BRIEF DESCRIPTION OF THE DRAWINGS

The invention is now described by way of example with reference to the accompanying drawings in which.

DETAILED DESCRIPTION OF THE DRAWINGS

Figure 1:
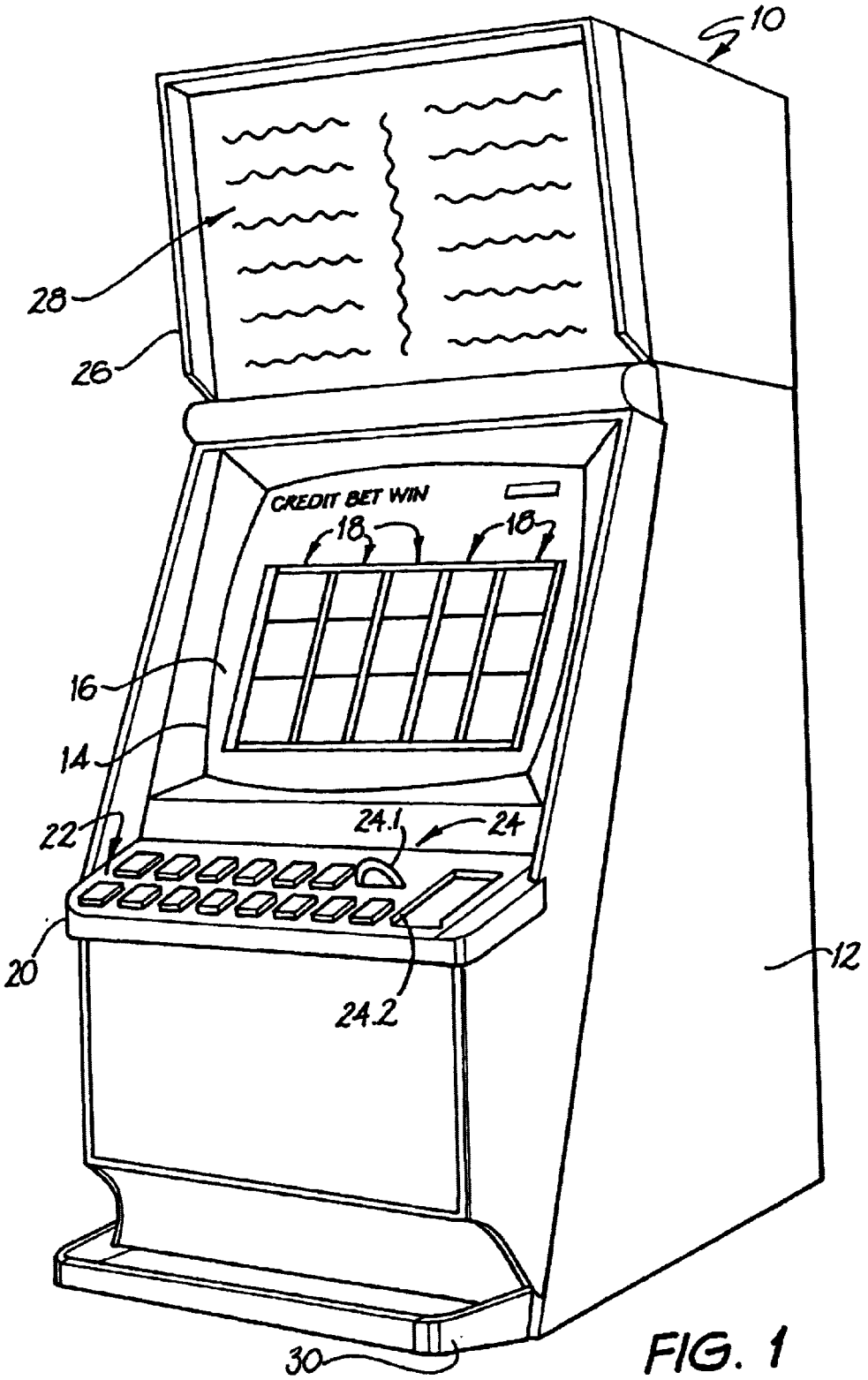
FIG. 1 shows a three dimensional view of a gaming machine, in accordance with the invention.

In FIG. 1, reference numeral 10 generally designates a gaming machine, including a game, in accordance with the invention. The machine 10 includes a console 12 having a video display unit 14 on which a game 16 is played, in use. The game 16 is a spinning reel game which simulates the rotation of a number of spinning reels 18. A midtrim 20 of the machine 10 houses a bank 22 of buttons for enabling a player to play the game 16. The midtrim 20 also houses a credit input mechanism 24 including a coin input chute 24.1 and a bill collector 24.2.

The machine 10 includes a top box 26 on which artwork 28 is carried. The artwork 28 includes paytables, details of bonus awards, etc.

A coin tray 30 is mounted beneath the console 12 for cash payouts from the machine 10.

Figure 2:
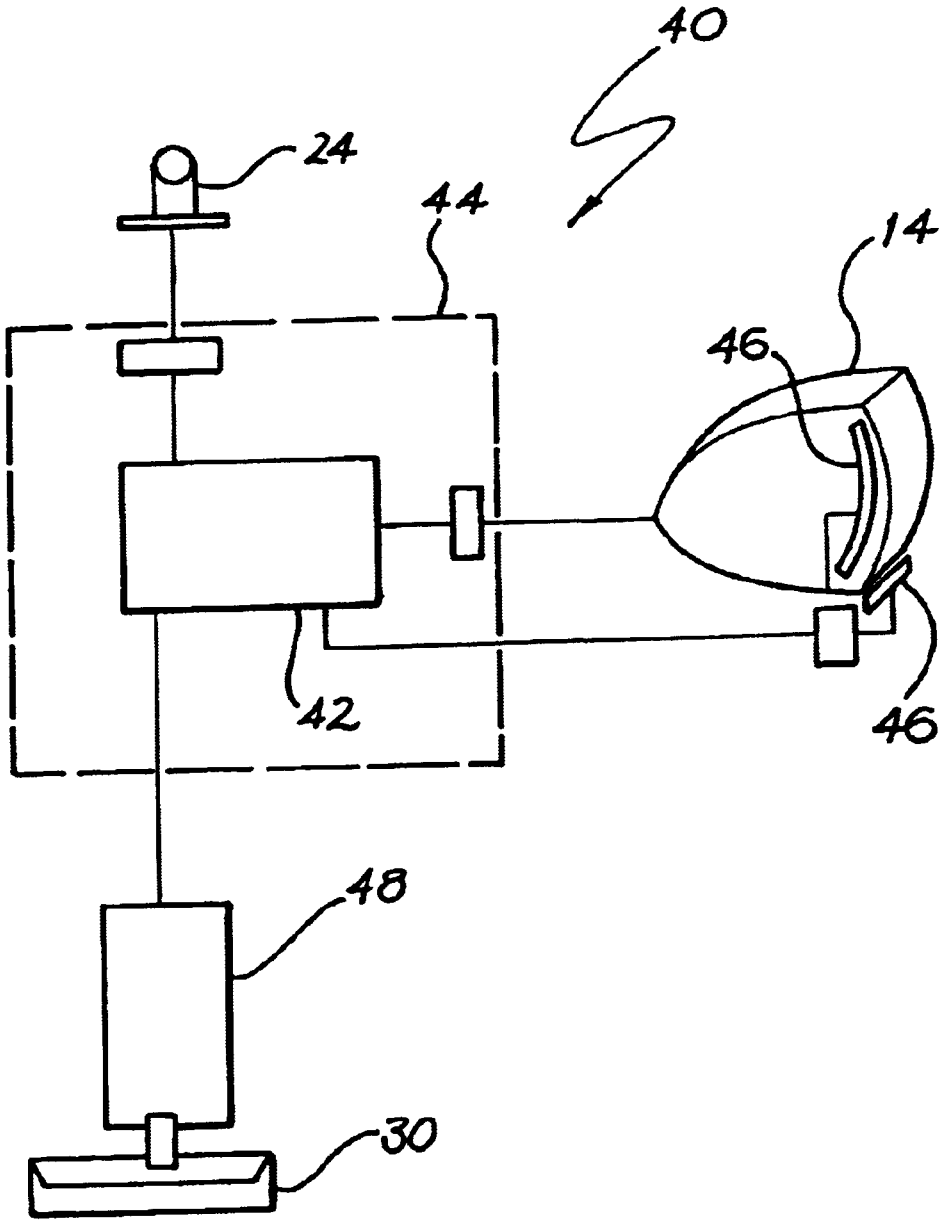
FIG. 2 shows a schematic, block diagram of a control circuit of the gaming machine of FIG. 1.

Referring now to FIG. 2 of the drawings, a control means or control circuit 40 is illustrated. A program which implements the game and user interface is run on a processor 42 of the control circuit 40. The processor 42 forms part of a controller 44 which drives the screen of the video display unit 14 and which receives input signals from sensors 46. The sensors 46 include sensors associated with the bank 22 of buttons and touch sensors mounted in the screen. The controller 44 also receives input pulses from the mechanism 24 indicating that a player has provided sufficient credit to commence playing. The mechanism 24 may, instead of the coin input chute 24.1 or the bill collector 24.2, or in addition thereto, be a credit card reader (not shown) or any other type of validation device.

Finally, the controller 44 drives a payout mechanism 48 which, for example, may be a coin hopper for feeding coins to the coin tray 30 to make a pay out to a player when the player wishes to redeem his or her credit.

A game, according to the invention is, preferably, a spinning reel game and includes a free game feature. It will be appreciated that the free game feature normally comprises a series of free games after a base game.

The free game feature may be triggered by a specific trigger condition or, under the control of the game controller 44, a random event may cause the free game feature to be activated.

Figure 3:
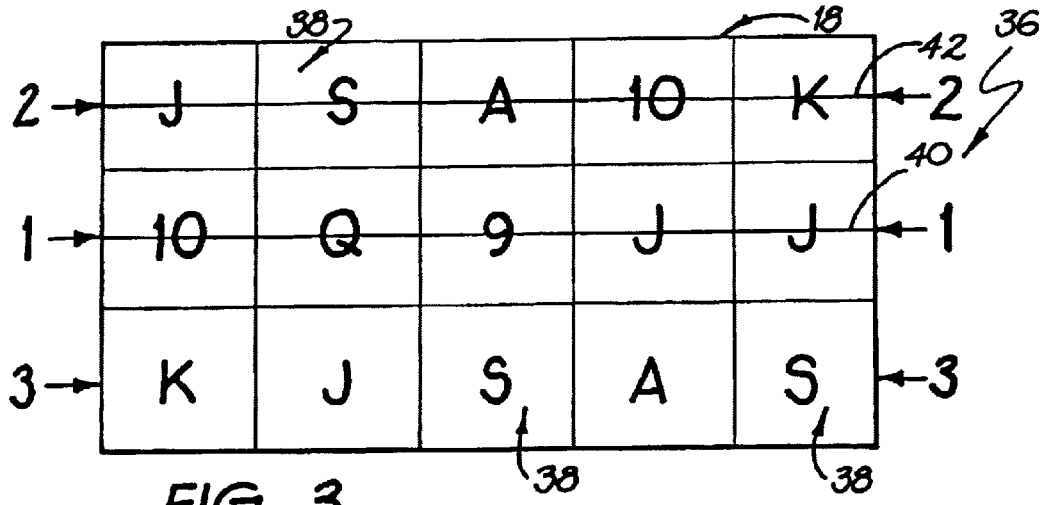
FIG. 3 shows a schematic representation of a screen of a base game played on the gaming machine of FIG. 1.

In the embodiment illustrated in FIG. 3 of the drawings, an end result of a base game 36 is shown. Due to the presence of three scatter symbols 38, which, typically, may be represented by treasure chests, a trigger condition is present and the free game feature is triggered. The free game feature comprises a series of free games such as, for example, ten or fifteen free games. During each free game all wins are doubled.

It is to be noted that the player has bet only on two of the possible paylines being the first payline 40 and the second payline 42.

Figure 4A:
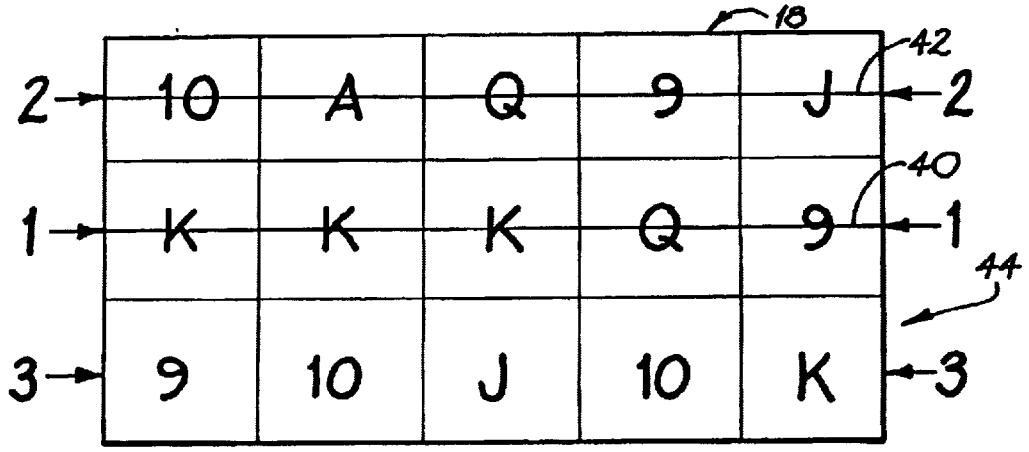
FIGS. 4*a* to 4*e* show a sequence of screens of two feature games of a series of feature games following the base game of FIG. 3.

After the trigger condition, the reels 18 of the gaming machine 10 are spun again. Screen displays of a result of the first free game and the subsequent feature are shown at 44 in FIGS. 4*a* to 4*c* of the drawings.

As described above, the player has only bet on the first payline 40 and the second payline 42. In this example, the machine pays for a standard left-to-right combination but, in other games, the machine may also pay for right-to-left combinations and/or "any" combinations. For the result shown in FIG. 4*a* of the drawings, the player is awarded a prize for the 3×K on the first payline 40. Because it is during a free game of a series of free games, the prize awarded is double the standard prize for 3×K.

Figure 4B:
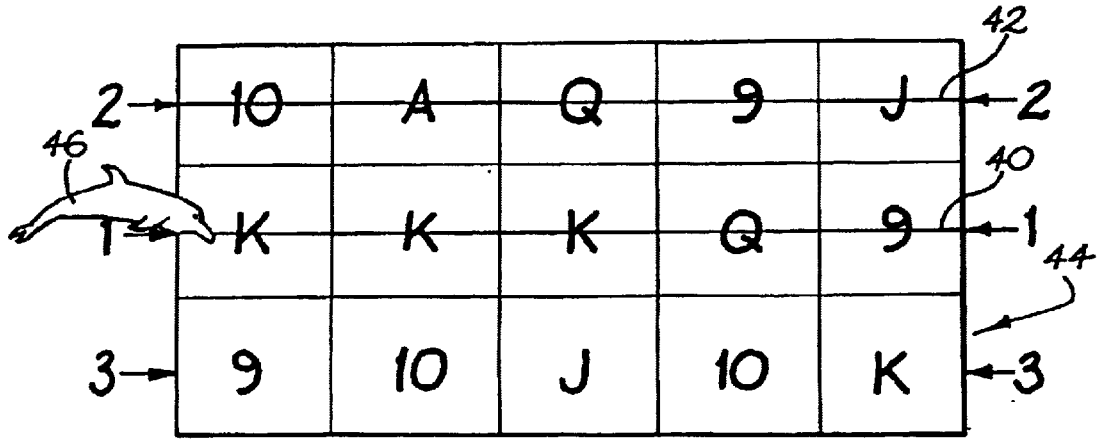
Figure 4C:
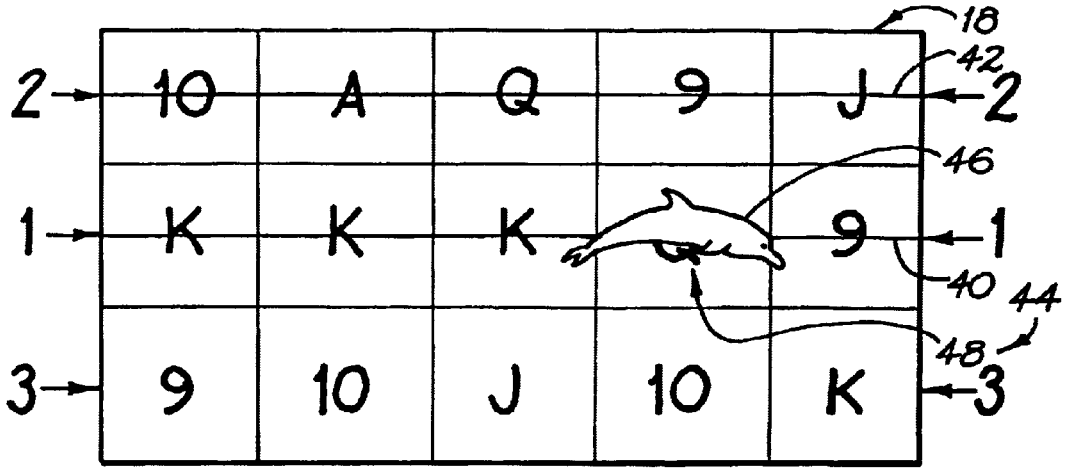

A substitute symbol, in the form of a dolphin 46, then "enters" the screen display 44 from a predetermined position and migrates across the screen. As illustrated in FIG. 4*b* of the drawings, the dolphin 46 is on the first payline 40 and migrates to an end position superimposed over a Q symbol 48 on the fourth reel 18 as shown in FIG. 4*c* of the drawings. In other words, the dolphin "swims" to a predetermined position on the screen. The animation may include the dolphin 46 "diving" into the symbol for which it substitutes, in this case the Q symbol 48.

If the position at which the dolphin 46 stops forms part of a prize winning combination, a further prize is paid for that free game, but only for that winning combination which includes the dolphin 46. Thus, as illustrated in FIG. 4*c* of the drawings, the dolphin 46 is superimposed over the Q symbol 48 and substitutes for the Q symbol 48 on the first payline 40. Hence, a further prize is paid for 4×K with the prize again being double that of the value of the prize for 4×K of the base game due to its being awarded during a free game.

Figure 4D:
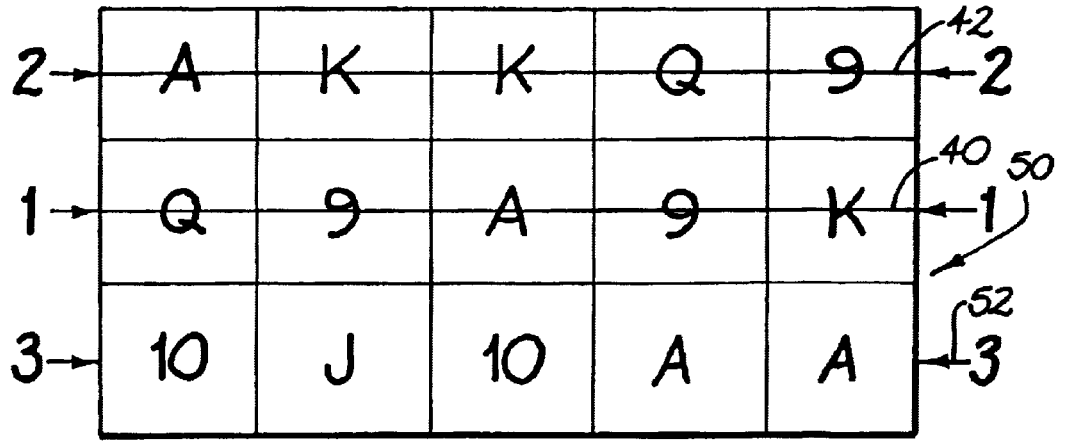
Figure 4E:
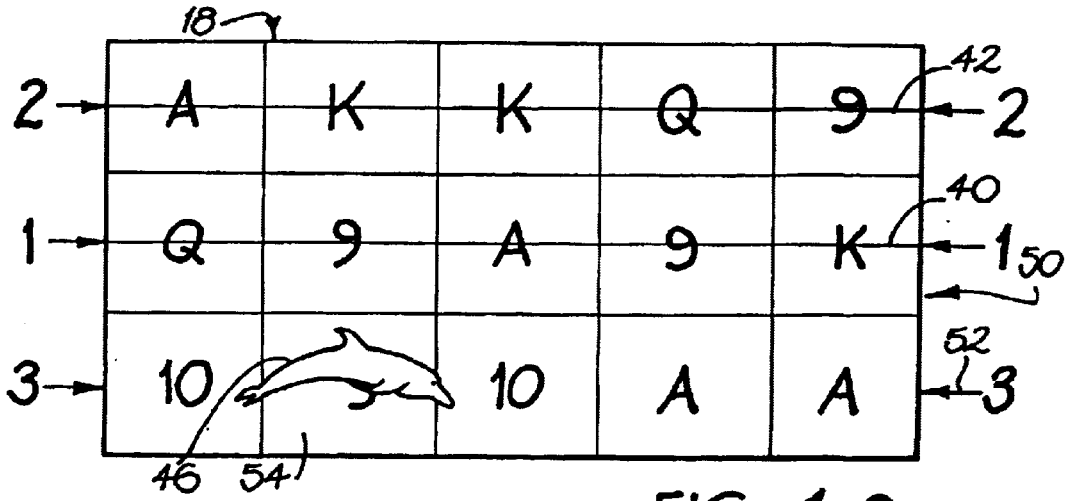

FIGS. 4*d* and 4*e* illustrate a screen display 50 of a second free game of the series of free games. The result shown in FIG. 4*d* indicates that no prize winning combinations of symbols exist on the paylines 40 and 42 being played by the player and no prize is awarded. The dolphin 46, in this free game, appears in a position on the third payline 52 and substitutes over a J symbol 54 on the second reel 18. Due to the fact that the player is not playing the third payline 52, the third payline 52 is inactive. Accordingly, although the dolphin 46 substitutes for the J symbol 54 to make a prize winning combination of three tens, due to the fact that the third payline 52 is inactive, no prize is awarded to the player.

A similar procedure is followed for the remaining games in the series of free games. It is to be noted that the position at which the dolphin 46 substitutes may differ in every free game. Thus, with the ten or fifteen free games in the free game feature, the dolphin 46 may substitute at a different position in each game. The position at which the dolphin 46 substitutes may be selected randomly by the game controller 44, or, instead, the dolphin 46 could move sequentially from position to position in each free game. Thus, for example, the dolphin may start at the first symbol on the reel at the end of the first free game and then migrate to the first position at the second reel at the end of the second free game and so on. Instead, as described, the dolphin 46 could move randomly between positions during the free game feature.

It is also to be noted that, if during any free game the trigger condition again arises, a further series of free games is added to the number of free games remaining from the preceding series of free games. The dolphin feature is also applicable during the second and any subsequent series of free games.

Hence, it is an advantage of the invention, that a game is provided which, the applicant believes, will enhance player interest.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The claims defining the invention are as follows:

1. A gaming machine having a display means and a game control means arranged to control images displayed on the display means, the game control means being arranged to play a game wherein one or more random events are caused to be displayed on the display means and, if a predefined winning event results, the machine awards a prize, the gaming machine being characterized in that, when a trigger condition occurs in a base game, a feature is triggered comprising at least one secondary game, the playing of the, or each secondary game occurring independently of a result of the base game which triggered the feature and when the, or each secondary game is completed, a special symbol appears at at least one symbol position of the completed secondary game, the special symbol replacing, at least temporarily, an underlying symbol at said symbol position to contribute, if applicable, to a prize winning event and said at least one symbol position at which said special symbol appears being independent of the trigger condition in the base game.

2. The gaming machine of claim 1 in which the, or each, secondary game is one of a free game and a bonus game.

3. The gaming machine of claim 2 in which the feature is a series of free games, the series of free games being triggered by said trigger condition in the base game.

4. The gaming machine of claim 3 in which the appearance of the special symbol occurs in each game of the series of free games.

5. The gaming machine of claim 3 in which the game control means is operable, after payment of a prize, if any, in a first free game of the series of free games, to play the following free game of the serious by altering the symbols displayed on the display means and, once said following free game has been completed and a prize, if any, paid, the special symbol again appears at one of the symbol positions as chosen by the game control means.

6. The gaming machine of claim 3 in which the position chosen by the game control means at which the special symbol appears in one free game is governed by the position at which the special symbol appeared in a preceding free game with the chosen position of the special symbol in a first game of the series being determined by the game control means.

7. The gaming machine of claim 3 in which the position chosen by the game control means at which the special symbol appears in each free game of the series of free games is randomly determined by the game control means in each free game.

8. The gaming machine of claim 1 in which the game control means chooses a position from all displayed symbol positions on the display means with the special symbol appearing at the chosen symbol position.

9. The gaming machine of claim 1 in which the special symbol is a substitute symbol.

10. The gaming machine of claim 9 in which, when the substitute symbol appears in its substituting position, it substitutes for the underlying symbol and, if it substitutes in any further prize winning combination, the relevant prize is paid.

11. The gaming machine of claim 1 in which the special symbol is in the form of an animated character.

12. The gaming machine of claim 11 in which the animated character moves across the display means to the chosen position.

13. The gaming machine of claim 1 in which a win for a prize winning combination in the secondary game is an integer multiple of a win for the same prize winning combination in the base game.

* * * * *